US007997216B2

(12) United States Patent
Thornbury et al.

(10) Patent No.: US 7,997,216 B2
(45) Date of Patent: Aug. 16, 2011

(54) OUTDOOR FURNITURE WITH PROTECTIVE LAYERS

(75) Inventors: Thomas R. Thornbury, Los Angeles, CA (US); Jaime Landa, West Hills, CA (US)

(73) Assignee: Thornbury Investments, Inc., Valencia, CA (US)

( * ) Notice: Subject to any disclaimer, the term of this patent is extended or adjusted under 35 U.S.C. 154(b) by 557 days.

(21) Appl. No.: 11/704,855

(22) Filed: Feb. 12, 2007

(65) Prior Publication Data

US 2008/0029000 A1 Feb. 7, 2008

Related U.S. Application Data

(60) Provisional application No. 60/802,692, filed on May 24, 2006.

(51) Int. Cl.
*A47B 13/00* (2006.01)

(52) U.S. Cl. ..... 108/157.1

(58) Field of Classification Search ..... 108/50.12, 108/157.1, 157.16, 157.17, 157.14, 159–161, 108/153.1, 64; 5/633; 297/461, 423.41, 297/423.39, 452.17; 248/188.8
See application file for complete search history.

(56) References Cited

U.S. PATENT DOCUMENTS

| | | | | | |
|---|---|---|---|---|---|
| 2,281,629 | A | * | 5/1942 | Snow | 5/655 |
| 2,509,395 | A | * | 5/1950 | Madan | 297/462 |
| 3,002,789 | A | * | 10/1961 | Brown | 297/462 |
| 3,139,632 | A | * | 7/1964 | Johns | 5/484 |
| 3,425,472 | A | * | 2/1969 | Marino | 206/599 |
| 3,494,308 | A | * | 2/1970 | Perrin | 108/150 |
| 3,642,323 | A | * | 2/1972 | Taylor | 297/452.17 |
| 3,954,537 | A | | 5/1976 | Alfter et al. | |
| 4,195,882 | A | | 4/1980 | Daswick et al. | |
| 4,201,359 | A | * | 5/1980 | Baslow | 248/345.1 |
| 4,711,495 | A | | 12/1987 | Magder | |
| 5,315,726 | A | | 5/1994 | Borenstein | |
| 5,339,748 | A | * | 8/1994 | Bilotti | 108/90 |
| 5,381,643 | A | * | 1/1995 | Kazaitis et al. | 53/415 |
| 5,383,635 | A | * | 1/1995 | Barone | 248/188.1 |
| 5,402,738 | A | * | 4/1995 | Carr et al. | 108/157.1 |
| 5,579,613 | A | * | 12/1996 | Carr | 52/79.1 |
| 5,681,090 | A | | 10/1997 | Thomas | |
| 5,772,293 | A | * | 6/1998 | Hughes | 312/208.3 |
| 5,837,336 | A | * | 11/1998 | Ichimura et al. | 428/34.9 |
| 5,884,349 | A | * | 3/1999 | Gretsinger | 5/502 |
| 6,126,240 | A | * | 10/2000 | Tse | 297/461 |
| 6,264,157 | B1 | * | 7/2001 | Muyskens | 248/346.03 |
| 6,364,416 | B1 | * | 4/2002 | Rheault et al. | 297/423.41 |
| 6,653,360 | B2 | | 11/2003 | Gupta | |
| 6,670,012 | B2 | * | 12/2003 | Campbell et al. | 428/60 |
| 6,705,334 | B2 | * | 3/2004 | Altobelli | 135/16 |
| D500,622 | S | * | 1/2005 | Owen | D6/596 |
| 7,157,388 | B2 | | 1/2007 | Langley et al. | |
| 2005/0081294 | A1 | * | 4/2005 | Wolters | 5/613 |
| 2006/0043847 | A1 | * | 3/2006 | Baron | 312/228 |

* cited by examiner

*Primary Examiner* — Darnell M Jayne
*Assistant Examiner* — Matthew W Ing
(74) *Attorney, Agent, or Firm* — William W. Haefliger

(57) ABSTRACT

An article of furniture comprising, in combination: a core body consisting of first plastic foam material, a first layer extending at one or more of the top and sides of the core, and attached to the core, consisting of plastic soft material, a second layer covering the first layer and covering the top and sides of the body, and which is a waterproof plastic film material, and an outer exposed sheet removably covering said second layer, and consisting of an upholstery material or the like.

14 Claims, 6 Drawing Sheets

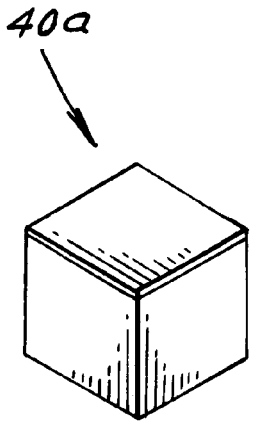
FIG. 7.
FIG. 8.
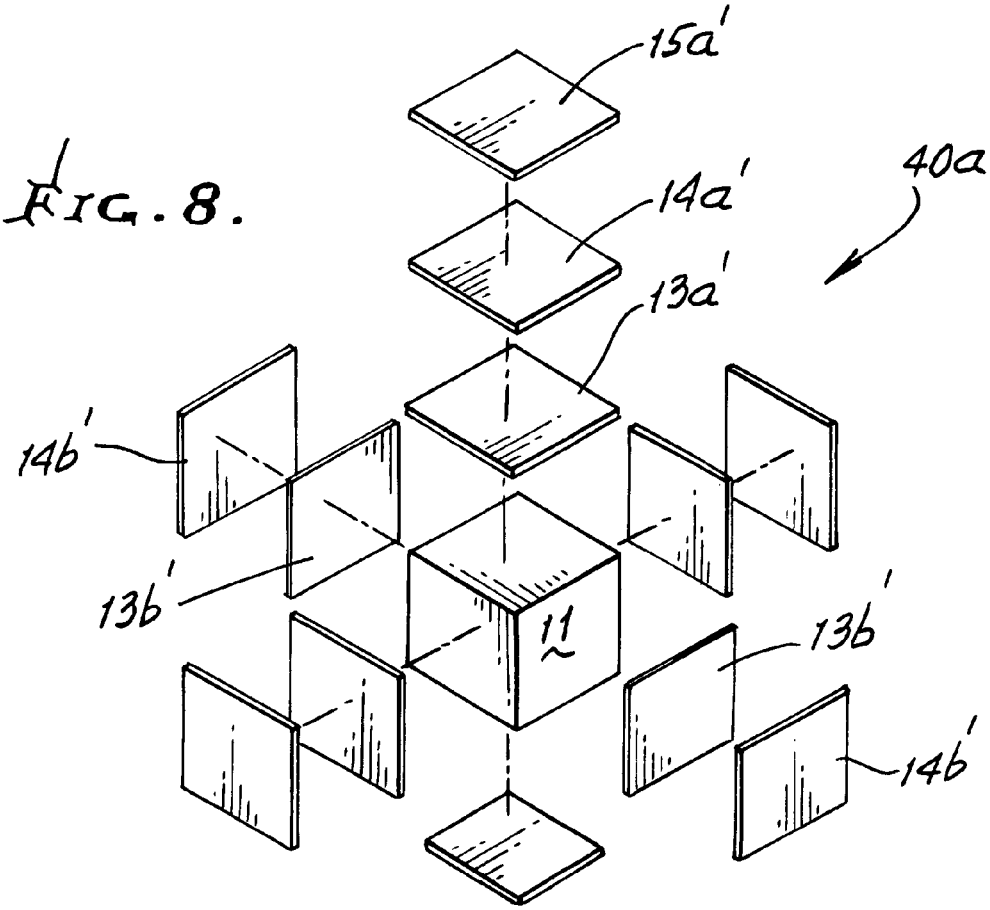

OUTDOOR FURNITURE WITH PROTECTIVE LAYERS

This application claims priority from provisional application Ser. No. 60/802,692 filed May 24, 2006.

BACKGROUND OF THE INVENTION

This invention relates generally to durable, outdoor furniture, and more particularly to lounge type furniture having very durable weatherproof construction and methods of making same.

There is continual need for inexpensive, attractive, and durable, block type outdoor furniture, of single, easy to manufacture construction. There is also need for block type furniture items of unusually advantageous layered construction, modes of operation or use, and having associated useful results.

SUMMARY OF THE INVENTION

It is a major object of the invention to provide furniture pieces satisfying the above expressed needs. Basically, the new and useful article of furniture comprises, in combination a) a core body consisting of first plastic foam material, b) a first layer extending at one or more of the top and sides of the core body, and attached to the core body, and consisting of plastic soft material, c) a second layer covering the first layer and covering the top and sides of the body, and which is a waterproof plastic film material, d) and an outer exposed sheet removably covering said second layer, and consisting of a wear resistant fabric material.

As will be seen, a plastic foam bottom layer may be bonded to the second layer.

Another object is to provide a method of integrating the body, layers and outer covering, as referred to.

A further object is to optimize the construction and use of such block type furniture by providing the core body to consist of expanded polystyrene or other fairly rigid polymer foam for load bearing seat requirements; providing the first layer cushioning material to consist of soft polyethylene foam which may be located at the body sides, and polyurethane foam at the body top; providing the second waterproofing layer to consist of polyolefin plastic sheet material; and providing the outer sheet removable cover to consist of vinyl upholstery grade material such as woven acrylic thread and at the bottom of cross-linked polyethylene (YLPE) foam. In this way, the in situ cover can be exposed to rain or other water sources, and will dry in sunlight, and the second waterproof layer will protect the first layer and core from contact with water to retain maximum cushioning function irregardless of the wetted condition of the cover and irregardless of whether the cover is on or off the block.

Additional objects include provision of articles of furniture having the above construction and also having configuration of a disc of diameter $D_1$ and height $H_1$ overlying and merging with a cylinder of diameter $D_2$ and height $H_2$ where $$D_1 > D_2$$

$$H_1 < H_2;$$

and further with the disc overhanging the cylinder by a radial amount R where $R < D_1$; and further with an optimized canopy overlying and spaced above part of the disc, and an upright strut connecting the canopy to the disc.

Other furniture configurations include a base beneath an upright cylinder and offset radially inwardly relative to the cylinder periphery; a tray supported at an upper surface of the block which may have various shapes as will be seen; and a lounge configuration with upper surface sections sloping at several varying angularities, as will be seen.

These and other objects and advantages of the invention, as well as the details of an illustrative embodiment, will be more fully understood from the following specification and drawings, in which:

DRAWING DESCRIPTION

FIG. 1 is a perspective view of an article of furniture in play-pad configuration;

FIG. 1*a* shows a modification to FIG. 1;

Figure 6:
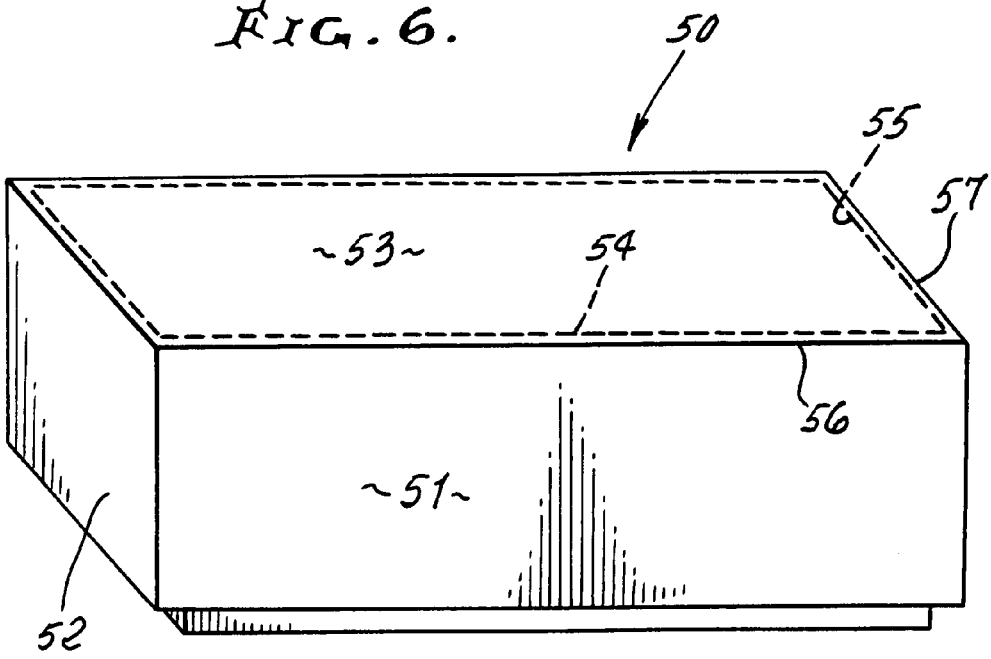
FIG. 6 is a perspective view of an elongated article of box-like configuration.
Figure 6A:
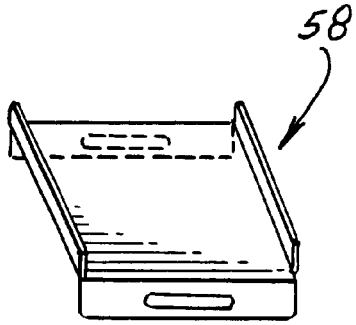
Figure 9:
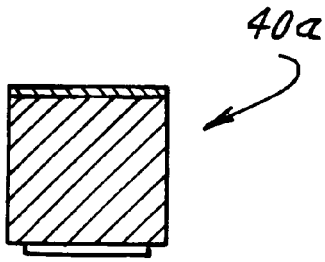
Figure 10:
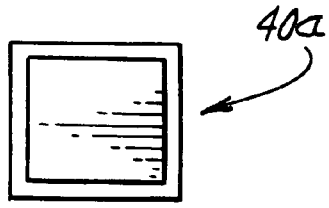
Figure 11:
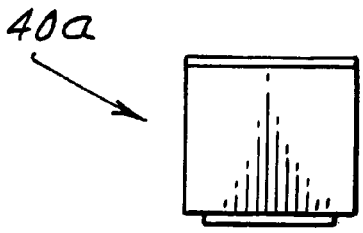
Figure 12:
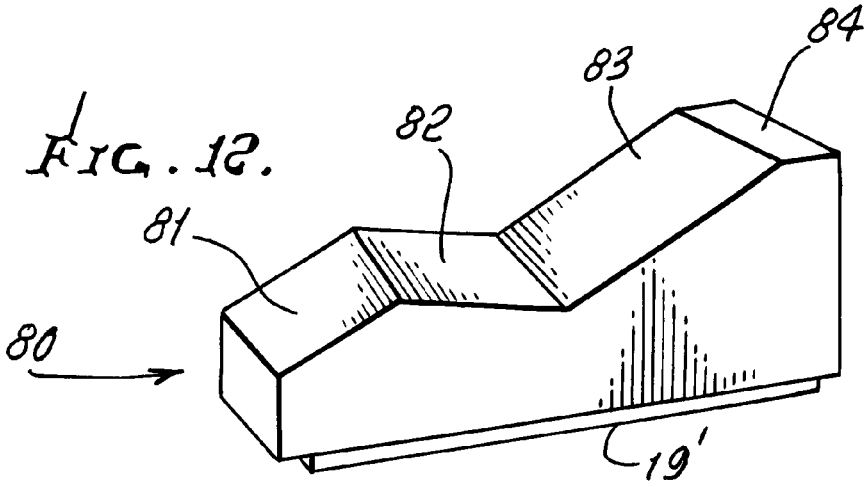
Figure 13:
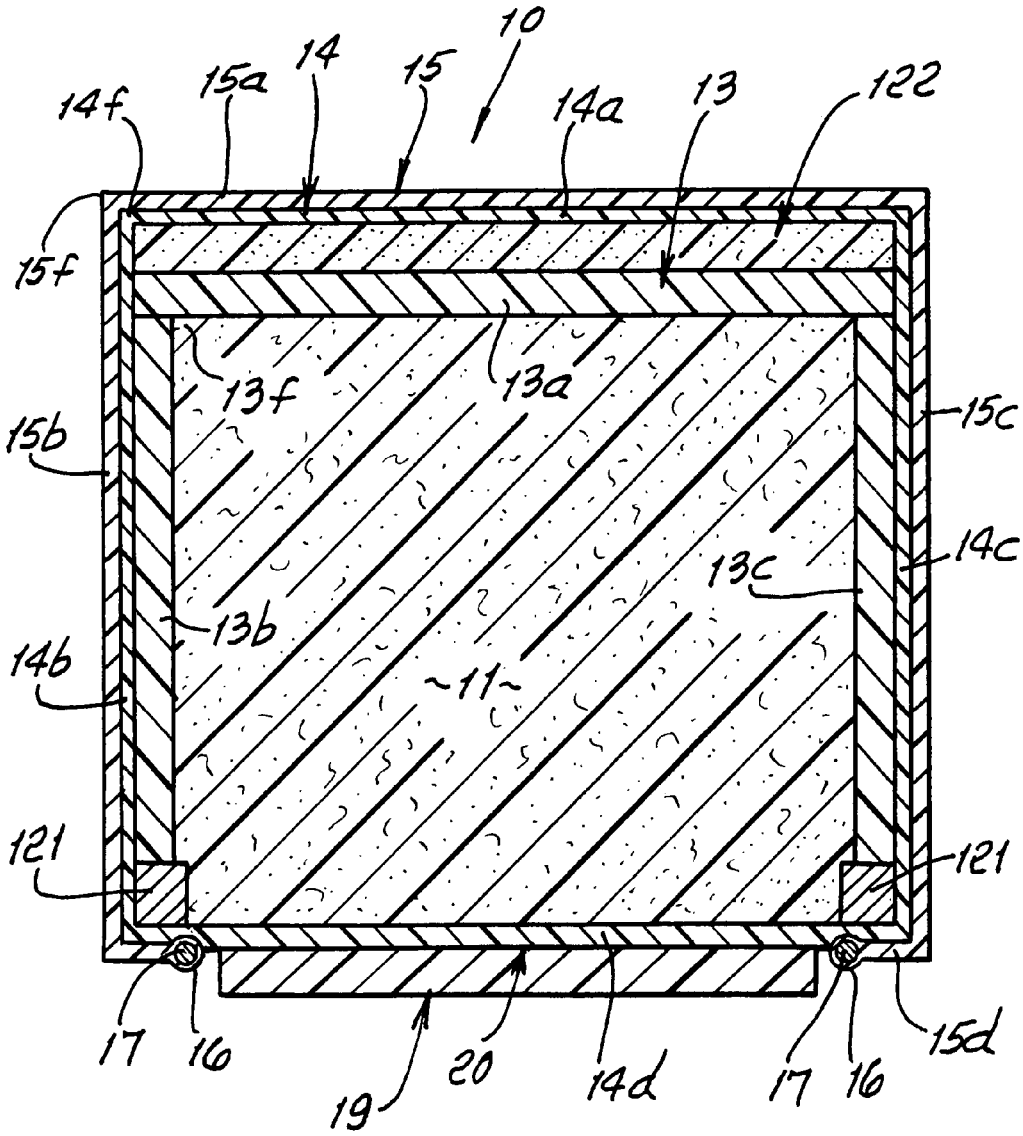

FIG. 6*a* is a view of a tray applicable to the top of the FIG. 6 article;

FIGS. 7-11 are views of cube-like articles construction;

FIG. 12 is a perspective view of an article of furniture in the form of a block-like lounge, with top surface angularities;

FIG. 13 is an enlarged fragmentary section taken through an article of furniture showing its layered construction, with corner supports.

DETAILED DESCRIPTION

Referring first to FIG. 13, the elements of the preferred block like article 10 of furniture include:

a) a core body 11 consisting of a first plastic foam material, b) a first layer 13 extending at one or more of the top and sides of the core body, as at 13*a*, 13*b*and 13*c*, attached to the core body, and consisting of a soft plastic material, for cushioning, with a bottom layer 22 of additional cushioning material, below corner supports 121, c) a second layer 14 covering layers 122 and 13*a*, and covering the top, sides and part of the bottom of the body, as at 14*a*-14*d*, and which is a waterproof plastic film material, d) and an outer exposed sheet 15 removably covering the second layer, as at 15*a*-15*d*, and typically consisting of a wearable material, such as marine grade vinyl or upholstery fabric or terry cloth.

Another layer 122 may be used and consist of polyurethane foam provided to add cushioning on top of 13*a*; rigid or semi-rigid lower corner supports 121 may also be employed, as shown and as referred to.

The core body 11 typically consists of EPS, i.e. expanded polystyrene foam; the first layer 13 typically consists of polyethylene foam, with adhesive connecting it to 11; the layer 122 typically consists of polyurethane foam, and corner supports 121 may consist of molded plastic material at four locations about the core; the second layer 14 typically consists of polypropylene film, heat shrunk into a over layer 13 about the entireties of 11 and 13 and 122; and the outer sheet 15 is fitted over sheet 14 and releasably connected in position, as for example by a draw string or strip 17 passed through loops 16 at the lower edge of 15, beneath the edge portions of the body such as below 14*d*. String or strings 17 pull the loops 16 toward a zone beneath the lower medial portion of the body 11, for tightening outer layer 15 in position maintaining substantially sharp or crisp upper edges 13*f*, 14*f*, and 15*f* of 13, 14 and 15, respectively. Velcro fastening is an alternative. Layer 15 is easily removable, as for cleaning.

A base 19 is shown adhered (as by adhesive) at 20 to the lowermost extent 14*d* of the film 14 under the body 11, to extend inwardly of and below the levels of loops 16, for their protection. Base 19 typically consists of cross-linked polyethylene foam which provides high strength.

The thickness $t_1$ of the various elements are as follows:

| | |
|---|---|
| 122 | $t_1$ - 1.5 inches on top. |
| 13 | $t_1$ .25 inch on sides and on top |
| 14 | $t_1$ - .003 to .004 inch |
| 15 | $t_1$ - .10 inch |
| 19 | $t_1$ - .75 inch |

Accordingly, the furniture provides cushioning; waterproofing; and wearability of an outer layer 15, removable for cleaning or replacement; and sturdy support on a base 19 of width which is over 60% of body width, to prevent overturning when the article of furniture is sat upon, as near its top edge. The illustrated article is a cube of approximately 18 inch edge dimensions.

Figure 1:
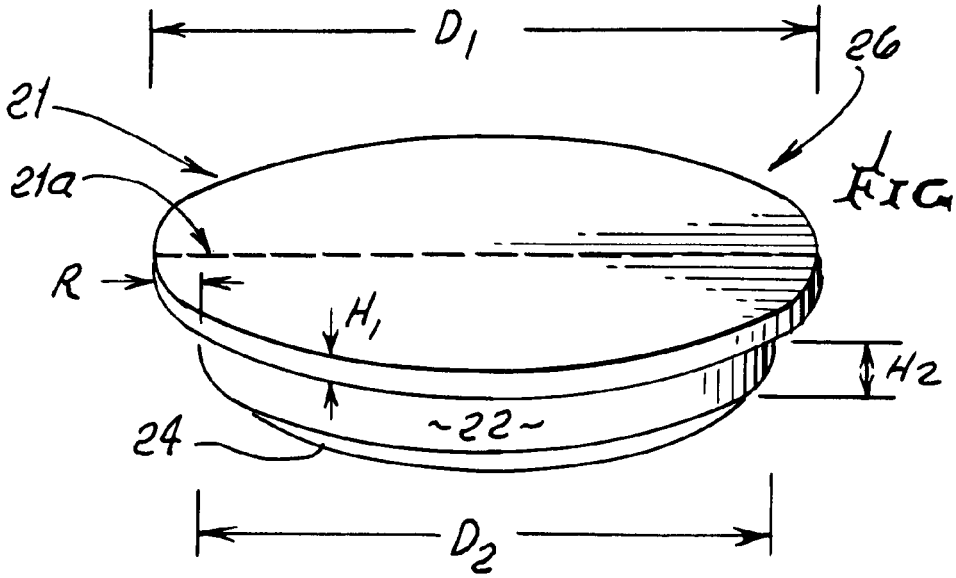
Figure 1A:
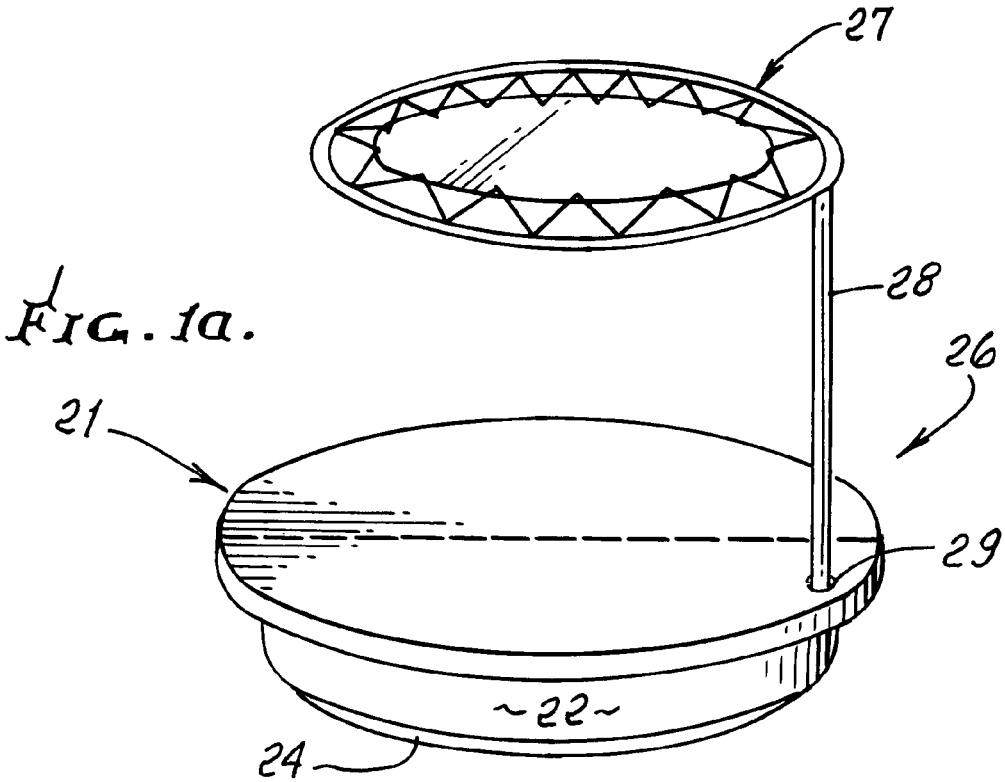

Referring now to FIGS. 1 and 1*a*, the article of furniture 26 embodying FIG. 13 construction, has the configuration of a disc 21 of diameter $D_1$, and height $H_1$, overlying and merging with a short upright cylinder 22 of diameter $D_2$ and height $H_2$, where $$D_1>D_2$$

$$H_1<H_2.$$

As shown, the disc and cylinder are coaxial and the disc peripheral zone 21*a* annularly overhangs the cylinder by a radial amount R where $$R<<D_1.$$

Each of 21 and 22 embody FIG. 13 construction. Top and side wall zones, as well as the underside of disc 21 overhang the side of the cylinder 22. Disc 21 and cylinder 22 may each be formed as two semicircular halves, with edge to edge engagement.

In FIG. 1 base 24 underlies the bottom of the cylinder, also indicated at 19 in FIG. 13, and may be suitably attached to that bottom, as by adhesive 20. The disc and cylinder surfaces are completely enclosed as by film layer or layers 14. A cover sheet for disc 21 may terminate downwardly and inwardly, adjacent the side of 22, above the base 24, to be easily removable. Core 11 remains waterproof protected, for cushioning whether or not the furniture is contacted by water. FIG. 1*a* is like FIG. 1, but shows a canopy 27 extended over part of the disc and supported by upright strut 28, the lower part of which is received in an opening 29 in the disc, for support.

Figure 2:
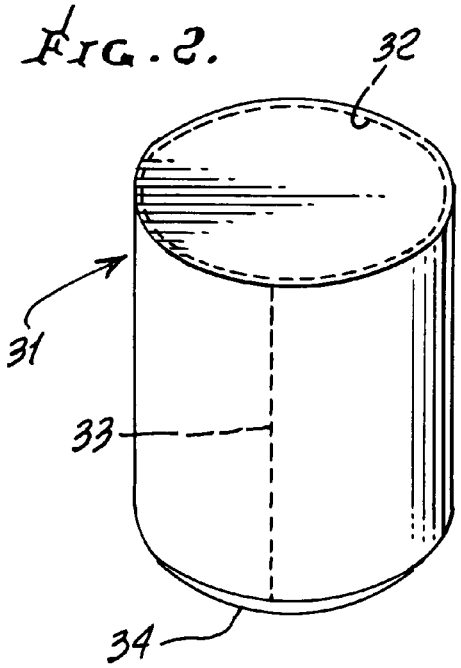
FIG. 2 is a perspective view of a cylindrically shaped article of furniture.
Figure 3:
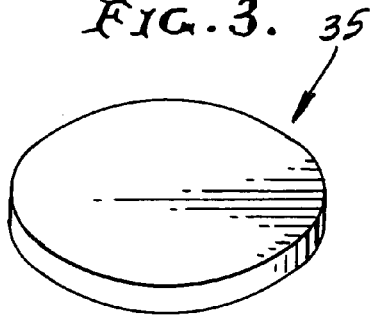
FIG. 3 is a view of a top tray applicable to the top of FIG. 2 cylinder.

FIG. 2 shows an article of furniture in upright cylinder form 31 and having construction as in FIG. 13. Broken lines 32 and 33 indicate edge seams (as by stitching) in the outer cover material 15, which is removable, as referred to. A base or base elements 34 corresponding to 24 in FIG. 1, adhere to the bottom of the article, in the manner as disclosed in FIG. 13. FIG. 3 shows a cover or lid 35 that fits on the top of the cylinder 31, and includes cushioning plastic material in its construction.

Figure 4:
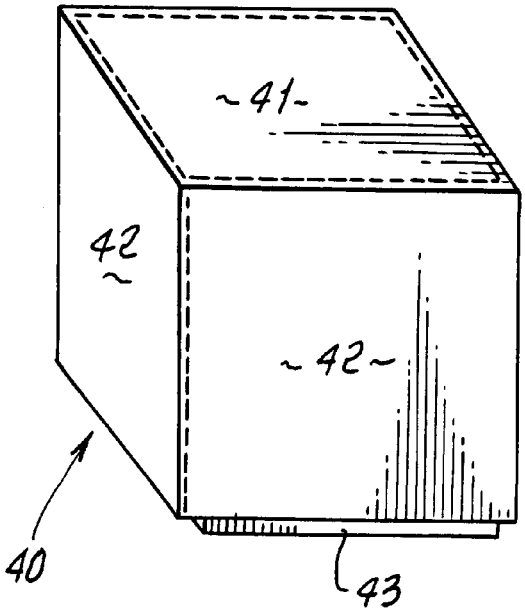
FIG. 4 is a perspective view of a cube shaped article of furniture.
Figure 5:
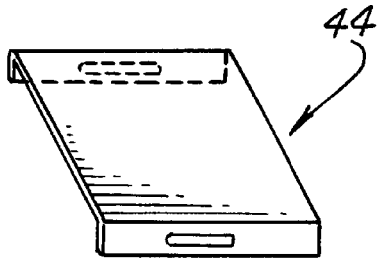
FIG. 5 is a view of a tray applicable to the top of the FIG. 4 article.

FIG. 4 shows cube form 40 of the article of furniture, and has a top 41 and four side walls 42. It also has the construction as disclosed in FIG. 13. A base or base elements 43 adhere to the bottom of the cube. FIG. 5 shows a tray 44 that is channel shaped to fit onto the top of the cube. The tray area may be less than top wall 41 area.

The furniture 50 of FIG. 6 is like FIG. 4, but is elongated, and also has the construction of FIG. 13. Side and end walls appear at 51 and 52. A horizontal top wall is designated at 53, and sealed seams in the cover appear at 54 and 55 adjacent sharp edges 56 and 57. A cushioning cover or lid for 50 is shown at 58 in FIG. 6*a*, and has channel shape. It may also define a tray.

FIGS. 7-11 show the construction of a modified cube form article 40*a*. The layers 14 and 15 are here defined by separate layers at each of the top and side walls. See for example separated top layers 13*a*′, 14*a*′ and 15*a*′; and separated side layers 13*b*′ and 14*b*′, at each side.

FIG. 12 shows an elongated lounge body 80 having FIG. 13 construction. The top surfaces 81-84 are relatively angled, as in S or wave shape, as shown. See also bottom support layer 19′. A first top surface has angularity $\alpha$, relative to horizontal, a second and next in sequence top surface has angularity $-\alpha_2$, and the next in sequence top surface has angularity $\alpha_3$ relative to horizontal, where $$\alpha_3>\alpha_1$$

$$-|\alpha_2|<\alpha_1$$

$$-|\alpha_2|<\alpha_3$$

We claim:

1. An article of furniture comprising, a support, said support comprising, in combination:

a) a core body consisting of expanded polystyrene in a block shape, b) a first layer having a first top portion covering a top of said core body, and a plurality of first side portions each covering a side of said core body, wherein said first top portion consists of polyurethane foam, and said first side portions consist of polyethylene foam.

c) a second layer covering the first layer and covering the top, and sides and bottom of the body, said second layer consisting of waterproof polypropylene heat-shrinkable film, d) and an exposed tension outer sheet removably covering said second layer, said outer sheet consisting of upholstery grade vinyl, and extending under lowermost corners of the second layer, e) said core body having a plurality of lower grooves, and an internal and local reinforcement member in each of said lower grooves, each of said reinforcement members having a rectangular cross-section, an upper surface, a lower surface, an inner said surface, and an outer side surface, said inner side surface being located within one of said lower grooves, said outer side surface and said lower surface intersecting to form a first corner, said first corner being covered by one of the lowermost corners of said second layer, wherein said first corner provides an internal L-shaped edge structural support to maintain said lowermost corner substantially sharp, externally, under the outer sheet, wherein each said first side portion has a bottom surface contacting the upper surface of one of said reinforcement members, f) and wherein said first layer has thickness $t_1$, said second layer has thickness $t_2$, and said outer sheet has thickness $t_3$ where $t_1 > t_2$ $t_2 = 0.003$ to $0.004$ inch $t_3 = 0.010$, g) a cushioning pad contained under said second layer and said outer sheet, and extending over the entirety of said core body, h) a base adhesively adhered to the lowermost extent of said second layer under the core body, the base consisting of cross-linked polyethylene foam, i) drawstring means connecting the outer sheet in position, and tightening means protectively located under said body and above the lowermost level of the base, j) and wherein said tightening means is confined between said lowermost corners of the second layer and sides of the base, holding a lowermost extent of the outer sheet in position, k) and wherein said drawstring means is protectively tied and concealed proximate the bottom of said article, and literally spaced from the base, l) wherein a first distance between a side surface of said base and a side portion of said outer sheet is at least twice the height of the base, and m) said outer sheet is removable from open covering relation to said second layer.

2. The article of claim 1, further comprising a disc of diameter $D_1$ and height $H_1$ overlying and merging with the support, said support being cylindrical with a height $H_2$ and a diameter $D_2$ wherein, $D_1 > D_2$ $H_1 < H_2$.

3. The article of claim 2 wherein the disc overhangs the support by a radial amount R where $R < D_1$.

4. The article of claim 2 including a canopy overlying and spaced above part of the disc, and an upright strut connecting the canopy to the disc.

5. The article of claim 2 wherein said base is and offset radially inwardly relative to the periphery of said support.

6. The article of claim 1 wherein said support is cylindrical.

7. The article of claim 6 including a tray supported on the uppermost surface of the support.

8. The article of claim 1 wherein said support is shaped as an elongated box with opposite parallel sides, said support having a horizontal length greater than a height of said support.

9. The article of claim 8 including a tray supported on an upper surface of the support, the tray having length substantially less than the length of said support.

10. The article of claim 1 wherein said support is shaped as a cube.

11. The article of claim 1 wherein said support is shaped as a lounge with multiple flat top surfaces.

12. The article of claim 11 wherein said support has first, second, and third top surfaces in sequence, the first top surface has angularity $\alpha$, relative to horizontal, the second top surface has angularity $-\alpha_2$ relative to horizontal, and the third top surface has angularity $\alpha_3$ relative to horizontal, where $\alpha_3 > \alpha_1$ $-|\alpha_2| < \alpha_1$ $-|\alpha_2| < \alpha_3$.

13. The article of claim 1 including a tray applicable to the top of said support, said tray having flanges to embrace said support.

14. The combination of claim 1 wherein the core body is elongated and said drawstring extends beneath said core body.

* * * * *